US005815959A

United States Patent [19]

Bahner et al.

[11] Patent Number: 5,815,959

[45] Date of Patent: Oct. 6, 1998

[54] BUCKET SHAPED FOR REDUCED HEEL WEAR

[75] Inventors: Delaine D. Bahner, Rossville; Gary R. Woerman, Wamego, both of Kans.

[73] Assignee: Caterpillar Inc., Peoria, Ill.

[21] Appl. No.: 847,905

[22] Filed: Apr. 28, 1997

[51] Int. Cl.[6] ..... E02F 3/40

[52] U.S. Cl. ..... 37/444; 37/379; 414/722

[58] Field of Search ..... 32/329, 443; 37/444, 37/445; 414/722, 723; 294/55, 68.1; D15/32, 25

[56] References Cited

U.S. PATENT DOCUMENTS

| | | | |
|---|---|---|---|
| 2,489,898 | 11/1949 | Kluckhohn | 37/444 X |
| 3,458,069 | 7/1969 | Wickberg et al. | 414/722 |
| 3,481,056 | 12/1969 | Meade et al. | 414/722 X |
| 3,659,730 | 5/1972 | Butler | 37/444 |
| 4,279,085 | 7/1981 | Arnold | 37/444 |
| 4,304,058 | 12/1981 | Schwappach | 37/444 |
| 4,428,173 | 1/1984 | Knell | 52/731 |
| 4,523,397 | 6/1985 | Lucas . | |
| 4,854,813 | 8/1989 | Degeeter et al. | 414/723 |
| 5,371,959 | 12/1994 | Ahs | 37/443 |
| 5,526,591 | 6/1996 | Otwell | 37/444 |

*Primary Examiner*—Tamara L. Graysay
*Assistant Examiner*—Thomas A. Beach
*Attorney, Agent, or Firm*—O. Gordon Pence

[57] ABSTRACT

In earthmoving buckets, and more especially in deep buckets, the heel portion is subjected to excessive wear due to its extended shape rubbing or impinging upon excavation material while engaged in digging operations. The present invention teaches a bucket shape which reduces the wear of the heel portion while retaining bucket capacity by using a multiple radius design to define the shape in profile.

8 Claims, 2 Drawing Sheets

BUCKET SHAPED FOR REDUCED HEEL WEAR

TECHNICAL FIELD

The present invention relates generally to earthmoving buckets and more particularly to a bucket shaped for reduced heel wear for use with construction and earthworking machinery.

BACKGROUND ART

Excavating machinery are equipped with a bucket for digging and moving various materials. Such machinery are often used in road and building construction, ditch-digging and pipe-laying operations. The buckets are subjected to severe wear, particularly when used with abrasive materials or when the bucket shape tends to excessively rub or impinge the excavation material.

A bucket used for narrow or sharp-edged excavation operations is usually shaped more narrowly and deeper than buckets used in typical mass excavation operations and is often found on hydraulic excavators or backhoes. The deeper shape of such buckets allows efficient removal of excavation material while maintaining the desired excavation shape.

However, the deeper, narrower shape of this type bucket often leads to a particular wear problem at the rear, heel portion of the bucket. This wear occurs typically when the bucket is curled upward while in a digging or smoothing operation and the heel portion drags on or rubs the excavation material.

The present invention is directed to overcoming the wear problem set forth above.

DISCLOSURE OF THE INVENTION

In one aspect of the present invention, an earthmoving bucket has a first and second end walls, and a shell which includes a base plate portion, a rear wall portion, a heel portion and a bottom wall portion, and which extends laterally between the end walls. The bucket also includes a cutting edge which is on or attached to the bottom wall portion of the shell.

The rear wall portion of the bucket is shaped significantly in a first arc and extends from the base plate portion to the heel portion. The heel portion is shaped significantly in a second arc and extends from the rear wall portion to the bottom wall portion. Finally, the bottom wall portion is shaped significantly in a third arc and extends from the heel portion to the cutting edge.

In another aspect of the present invention, the shell is spiral-shaped and defined about an envelope of three progressively longer radii. The spiral shape starts at the base plate portion, the base plate being initially flat shaped. The shell then curls outwardly in a progressively opening curl on the three radii through the rear wall portion, the heel portion and the bottom wall portion.

The overall shape of the shell of the present invention is such that the heel portion is flatter compared to prior heel portions and intersects the rear wall portion at a higher point, the overall shell shape being significantly defined by three related radii.

BEST MODE FOR CARRYING OUT THE INVENTION

Figure 1:
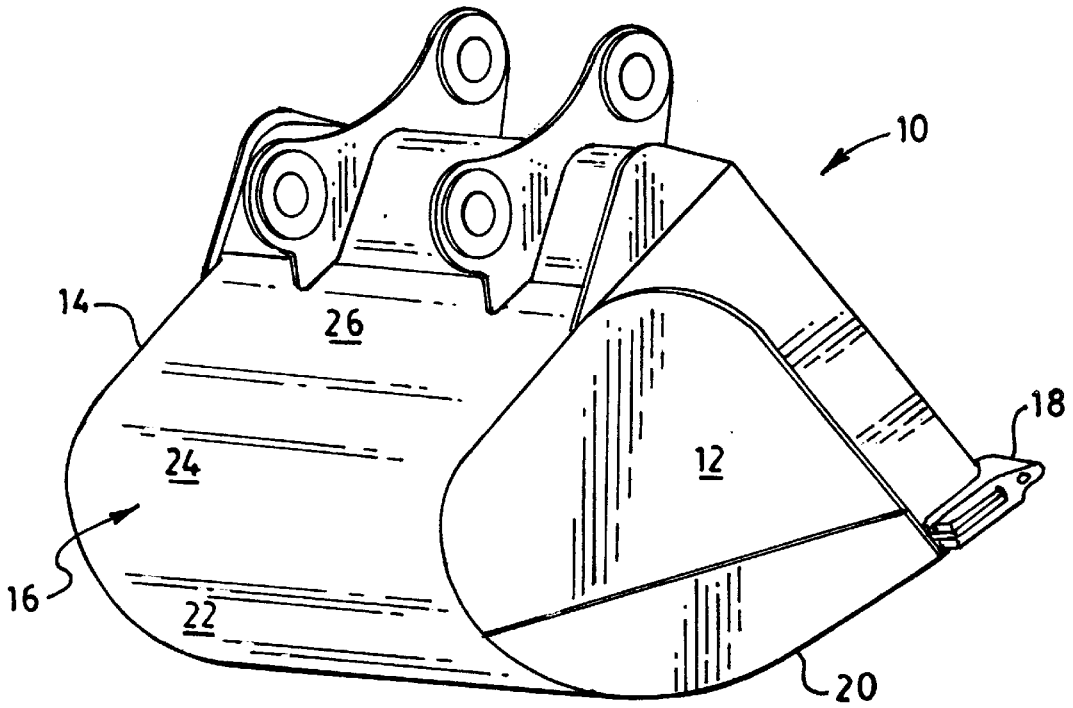
FIG. 1 is a diagrammatic perspective rear view of the earthmoving bucket of the present invention.

Referring to the drawings, an improved earthmoving bucket 10 includes first and second end walls 12,14, a shell 16 having a base plate portion 26, a rear wall portion 24, a heel portion 22 and a bottom wall portion 20, and which extends laterally between the ends walls 12,14. The rear wall portion 24 extends between the base plate portion 26 and the heel portion 22. The heel portion 22 extends between the rear wall portion 24 and the bottom wall portion 20. The bottom wall portion is adjacent to the heel portion 22. The cutting edge 18 is on the bottom wall portion 20.

The rear wall portion 24 is significantly shaped in or follows a first arc 54, with the first arc 54 preferably intersecting the base plate portion 26 and the heel portion 22 at first and second tangent intersections 74,72, respectably. A tangent intersection is defined as the place where two arcuate shapes intersect when the center points of the shapes are aligned, or where the radius of an arc intersects a plane at a right angle. The tangent intersection results in smooth transitions between adjoining portions.

The heel portion 22, similar to the rear wall portion 24 described above, is shaped in or follows a second arc 52. The second arc 52 preferably intersects the bottom wall portion 20 at a third tangent intersection 70, thereby resulting in a smooth transition between these portions.

The bottom wall portion 20, similar to the heel portion 22 described above, is shaped significantly in or follows a third arc 50.

To enable manufacture of the present invention, commercially reasonable manufacturing tolerances to provide the desired tangent intersection angles are acceptable.

Figure 3:
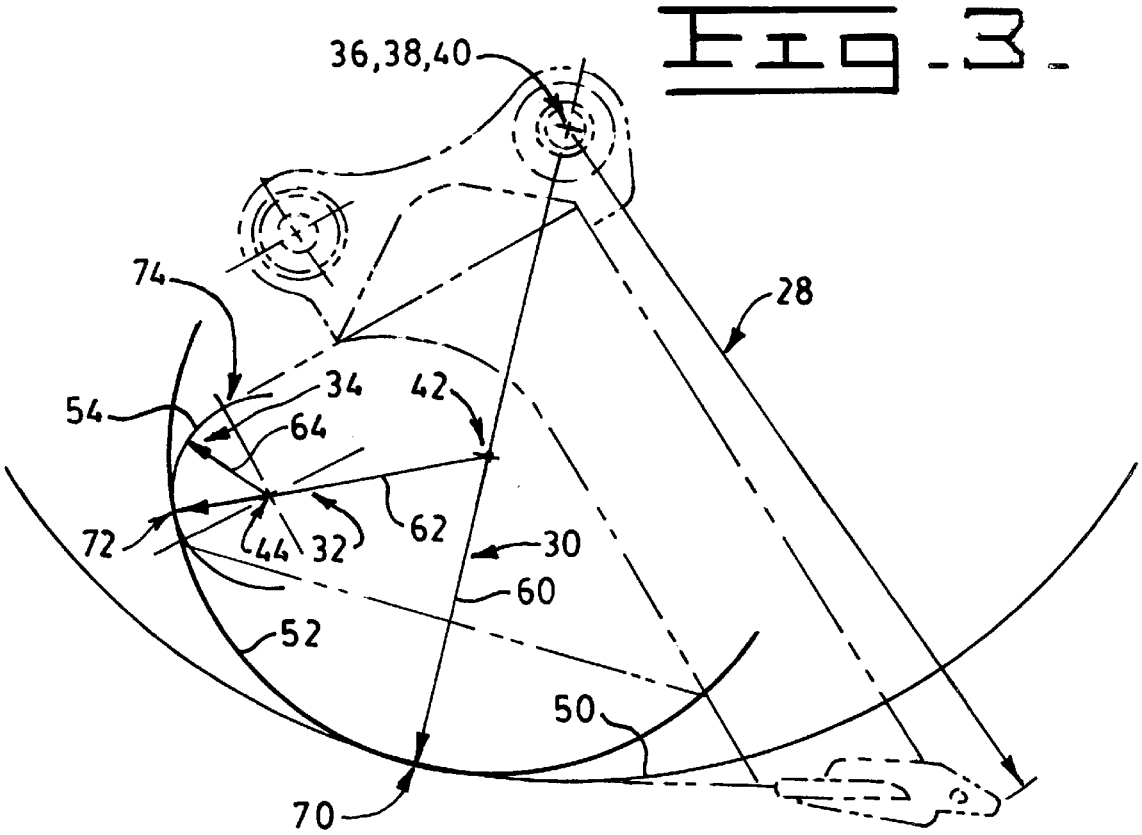
FIG. 3 is a diagrammatic side view of the earthmoving bucket of the present invention in phantom illustrating the relationship of the arcs defining the bucket.

In another aspect of the present invention, as best shown in FIG. 3, the first arc 54 and the second arc 52 are defined about a respective first radius 34 and second radius 32. The first radius 34 has a first length 64 and the second radius 32 has a second length 62. The length of the first length 64 is preferably from 20 to 80 percent of that of the second length 62, but if not, then the second length 62 is greater than the first length 64.

The first radius 34 lies upon a portion of the second radius 32 when the two radii 34,32 extend from their respective, aligned center points 44,42 to the second tangent intersection 72.

Likewise, the second arc 52 and the third arc 50 are defined about the second radius 32 and third radius 30. The second radius 32 has a second length 62 and the third radius 30 has a third length 60. The preferred length of the second length 62 is from 30 to 70 percent of that of the third length 60, but if not, then the third length 62 is greater than the second length 60.

The second radius 32 lies upon a portion of the third radius 30 when the two radii 32,30 are drawn from their respective arc center points 42,40 to the third tangent intersection 70.

Figure 2:
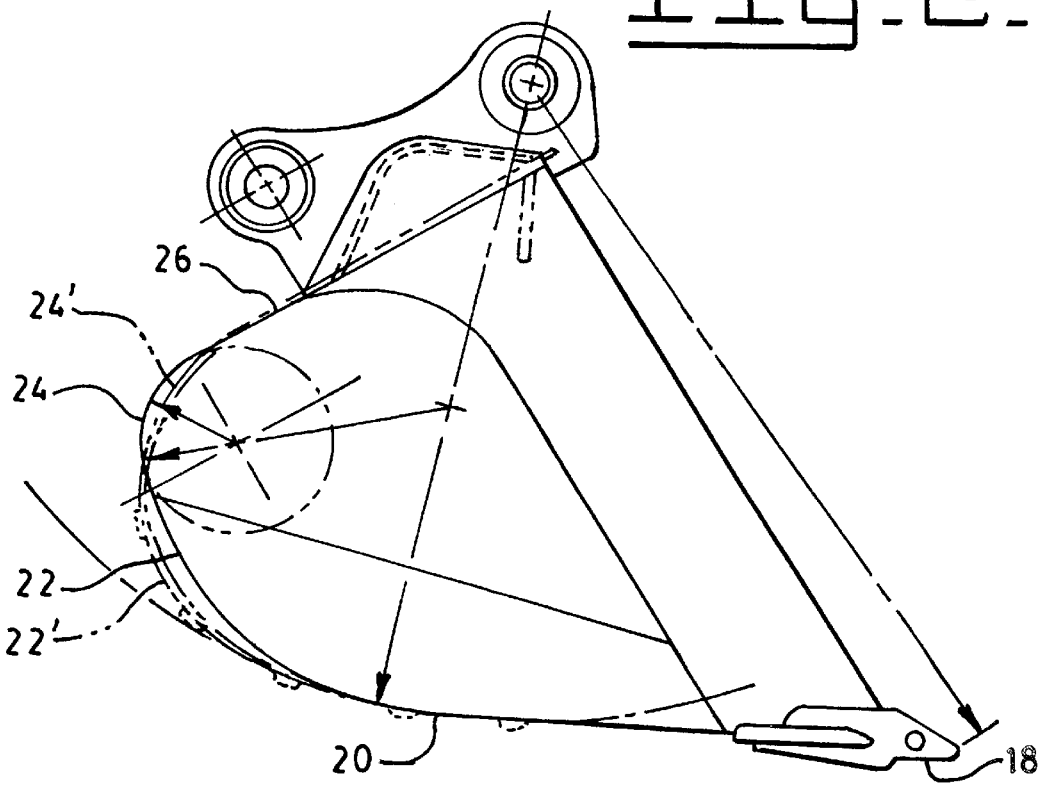
FIG. 2 is a diagrammatic side view of the earthmoving bucket of the present invention.

Referring again to FIGS. 2 and 3, the bucket 10 has a tip radius 28 centered at the tip radius center point 38 and extending to the cutting edge 18. Preferably, the tip radius 28 is longer than the third radius 30. The bucket 10 pivots about the stick pin pivot point 36 which is coincident with the third arc center point 40 and the tip radius center point 38.

In another aspect of the present invention, the shell 16 of the bucket 10 is preferably a continuous, unitary member, but may alternately be a fabricated member constructed in parts.

Industrial Applicability

When an earthmoving bucket 10 is operating in a digging operation, the shell 16 contacts excavation material in a sliding, frictional motion. To minimize wear while providing efficient operation, the shape of the shell 16 is designed to follow rounded contours which avoid excessive rubbing of impingement of excavation material not gathered inside the bucket 10.

Buckets 10 shaped for narrower excavation applications typically have shells 16 which are deeper than those on other buckets. The deeper shell design offsets the loss of bucket capacity caused by the narrower design.

The heel portion 22 of the shell 16 is more extended in deeper bucket designs and is therefore more exposed to excessive rubbing or impingement of excavation material. To maintain constant bucket capacity yet reduce heel portion 22 wear, the present invention teaches a bucket with the heel portion 22 reduced and the rear wall portion 24 increased in a three-radii relational manner.

The bucket 10 shape begins with a predetermined design capacity, such as one cubic yard, and a predetermined bucket width. The tip radius 28 is also a predetermined value based upon specific design criteria such as the backhoe or excavator power. From these and other job-specific design parameters, the third radius 30 of third length 60 is introduced at the third arc center point 40, thereby producing the corresponding third arc 50.

Next, the second radius 32 of second length 62 is introduced at the second arc center point 52. The second radius 32 produces the corresponding second arc 52 such that the heel portion 22 of the shell 16 is flattened compared to the prior art heel portion 22' shown in phantom in FIG. 2, and thereby does not excessively rub or impinge excavation material in digging operations.

Finally, the first radius 34 of first length 64 is introduced at the first arc center point 44. The first radius produces the corresponding first arc 54 such that the capacity in the bucket by the rear wall portion 24 of the shell 16 is increased compared to the prior art rear wall portion 24' shown in phantom in FIG. 2, and picks up any loss of bucket capacity lost in the heel portion 22 due to the shape change.

The lengths of the three radii 30,32,34 may be varied in the above-described relationship to yield the desired bucket capacity with the desired heel portion 22 shape.

Other aspects, objects and advantages of this invention can be obtained from a study of the drawings, the disclosure and the appended claims.

It is claimed:

1. In an earthmoving bucket having first and second end walls;

a shell defining a base plate portion, a rear wall portion, a heel portion, and a bottom wall portion, and extending laterally between said end walls, and with said rear wall portion being located between said base plate portion and said heel portion, and with said heel portion being located between said rear wall portion and said bottom wall portion, and with said bottom wall portion being adjacent to said heel portion; and a cutting edge on said bottom wall portion, the improvement comprising:

said rear wall portion significantly following a first arc, said first arc being defined by a first radius having a first length, said first radius extending from a first arc center point to said first arc;

said heel portion significantly following a second arc, said second arc being defined by a second radius having a second length, said second radius extending from a second arc center point to said second arc; and said bottom wall portion significantly following a third arc, said third arc being defined by a third radius having a third length, said third radius extending from a third arc center point to said third arc, and wherein said third arc center point is a stick pin pivot point.

2. The improvement of claim 1 wherein the upper bound of said first arc is a first tangent intersection located between said rear wall portion and said base plate portion.

3. The improvement of claim 1 wherein the lower bound of said first arc is a second tangent intersection located between said first arc and said second arc.

4. The improvement of claim 1 wherein the lower bound of said second arc is a third tangent intersection located between said second arc and said third arc.

5. The improvement of claim 1 wherein said third length is greater than said second length.

6. The improvement of claim 1 wherein said second length is greater than said first length.

7. The improvement of claim 1 wherein said shell is a continuous, unitary member.

8. The improvement of claim 1 wherein said shell is a fabricated member.

* * * * *